US005513478A

United States Patent [19]

Abt

[11] Patent Number: 5,513,478

[45] Date of Patent: May 7, 1996

[54] METHOD AND APPARATUS FOR THE MANUFACTURE OF INDIVIDUAL ROLLS FROM A WEB OF MATERIAL

[75] Inventor: Richard Abt, Branford, Conn.

[73] Assignee: George Schmitt & Co., Inc., Branford, Conn.

[21] Appl. No.: 145,477

[22] Filed: Oct. 28, 1993

[51] Int. Cl.[6] ..... B65B 63/04

[52] U.S. Cl. ..... 53/118; 53/137.2; 53/211; 53/587; 242/525.7

[58] Field of Search ..... 53/118, 119, 211, 53/137.2, 587, 589; 242/525.6, 525.7

[56] References Cited

U.S. PATENT DOCUMENTS

| | | | |
|---|---|---|---|
| 500,115 | 6/1893 | Crowell | 53/118 |
| 541,145 | 6/1895 | Arnott | 53/118 |
| 2,316,767 | 4/1943 | Bradley et al. | 53/211 X |
| 2,343,720 | 3/1944 | Van Norde | 242/525.7 X |
| 2,668,675 | 2/1954 | Wolfe | 53/118 X |
| 2,790,497 | 4/1957 | Heygel et al. | 242/525.7 X |
| 3,323,279 | 6/1967 | Matsui | 53/118 |
| 3,329,368 | 7/1967 | Mastriani | 242/525.7 |
| 3,441,232 | 4/1969 | Diebold et al. | 242/525.7 |
| 3,462,093 | 8/1969 | Peery | 242/525.6 X |
| 3,585,779 | 6/1971 | Thayer | 53/118 |
| 3,944,150 | 3/1976 | Jennerjahn | 242/525.7 |
| 4,056,918 | 11/1977 | Matsumoto | 53/118 |
| 4,249,359 | 2/1981 | Herrig et al. | 53/118 |
| 4,291,460 | 9/1981 | Stoehr | 53/118 X |
| 4,566,162 | 1/1986 | Brands | 242/525.7 X |
| 4,819,528 | 4/1989 | Chadwick | 242/525.7 X |
| 5,289,669 | 3/1994 | Gerber et al. | 53/118 X |
| 5,299,411 | 4/1994 | Yamamoto et al. | 53/211 |

*Primary Examiner*—John Sipos
*Assistant Examiner*—Daniel Moon
*Attorney, Agent, or Firm*—St. Onge Steward Johnston & Reens

[57] ABSTRACT

An apparatus and method for preparing wound rolls from a web of material is disclosed having a feeding roller which feeds a web of material into contact with a core having a central axis. A plurality of tuckers tuck the web of material about the core, then the web is wound about the core having an enlarged diameter. A sealant is applied to the wound rolls, while the rolls are on the core, so as to maintain the rolls in a tightly wound manner. The core is attached to two support members, at least one support member being movable between a position attached to the core and a position dislocated from the core. After the sealant has been applied, at least one support member moves to the dislocated position such that wound rolls may be removed from the core by a movable extractor. The extractor forces the wound and sealed rolls off the core, which has a reduced diameter, and into a bin. The core is then automatically returned to a position and condition for receiving and winding more stamps, thus allowing the process to begin again with no human intervention.

12 Claims, 8 Drawing Sheets

METHOD AND APPARATUS FOR THE MANUFACTURE OF INDIVIDUAL ROLLS FROM A WEB OF MATERIAL

BACKGROUND OF THE INVENTION

The present invention relates to the manufacture of individual wound rolls of materials, such as postage stamps, from a web of material, including slitting, winding, sealing and unloading of individual wound rolls to produce a roll of stamps.

In Applicant's copending application, entitled "An Apparatus and Method for Preparing Individual Wound Rolls from a Slitted Web of Material", Ser. No. 07/895,268, Applicant disclosed an apparatus which quickly wound a single roll of stamps from a slitted web of material. While this invention uniquely and advantageously winds the individual rolls, the stamps are left, however, to be manually packaged and manually removed. Manually packaging the stamps is disadvantageous because the wound rolls may unwind during the process. Furthermore, manual performance of these steps is time consuming and costly.

It would be desirable, therefore, to provide an apparatus and method for automatically and efficiently producing wound rolls of single strips of stamps, applying a closure, such as a retaining tape, around the stamps while the stamps are in a tightly wound condition, and removing the stamps quickly, thus allowing the process to begin again quickly and automatically.

SUMMARY OF THE INVENTION

Accordingly, it is an object of the present invention to provide an apparatus for producing wound rolls of single strips of stamps.

It is another object to of the invention to provide an apparatus which can apply a closure, for example a retaining tape, while the stamps are in a tightly wound roll.

It is yet another object of the present invention to provide an apparatus which can automatically remove the stamps after the rolls of stamps have been packaged.

It is a further object to provide an apparatus which can quickly remove the completely wound and packaged rolls of stamps and then automatically prepare itself to receive another roll of stamps for processing.

It is still a further object of the present invention to provide an apparatus which can wind, package, and remove many rolls of stamps simultaneously and in a cost-efficient manner.

To overcome the deficiencies of the prior art and to achieve the objects and advantages listed above, Applicant discloses an apparatus for slitting, winding, packaging and unloading individual rolls of stamps from a web. In particular, a machine is disclosed which feeds a web of stamps through a series of loops into a slitter and then into a winding and packaging mechanism. The winding mechanism includes a star-shaped roller which engages the perforations of the stamps and feeds the web of stamps onto an expandable core. A first tucker, having a concave surface area such that the tucker contacts the core at a plurality of points, tucks the leading edge of the web about the core. A second tucker tucks the leading edge of the web about the core by a freewheel which remains in a tucking position throughout the winding process. A source of compressed air blasts a burst of air towards the leading edge to tuck tightly the leading edge against the core and in back of the infeeding web. The core, which has an expanded diameter during winding, continues to turn, thus winding the web about the core. The tuckers and the compressed air thus cooperate to tuck the leading edge about the core at a plurality of points.

When the winding is nearly completed, the packaging mechanism advances some restraining material, such as tape, towards the nearly-wound roll. When a predetermined length of stamps have been rolled, a knife cuts the stamps. A second knife cuts the tape at a predetermined length, then the sealing tape is wound about the roll and held in place by the second tucker. A sealing unit, such as a heat sealing unit, is advanced towards the tape, and seals the tape onto itself. As such, the stamps are restrained in a tightly held manner.

After the stamps have been wound and sealed, the core contracts to a reduced diameter condition to facilitate removal of the rolled stamps. To further facilitate removal, one end of a support member of the core is withdrawn and an extractor, having a member which snugly surrounds the core, sweeps the length of the core and moves the rolls into a receiving bin.

After the wound rolls have been removed, the core is automatically expanded, such as by inflating, returned to a position to receive and wind more rolls of stamps. As such, the winding process can begin anew with no human intervention.

Other objects, aspects, and features of the present invention, in addition to those mentioned above, will be pointed out in, or will be understood, when the following detailed description is read in conjunction with the accompanying drawings.

DETAILED DESCRIPTION OF THE DRAWINGS

Figure 1:
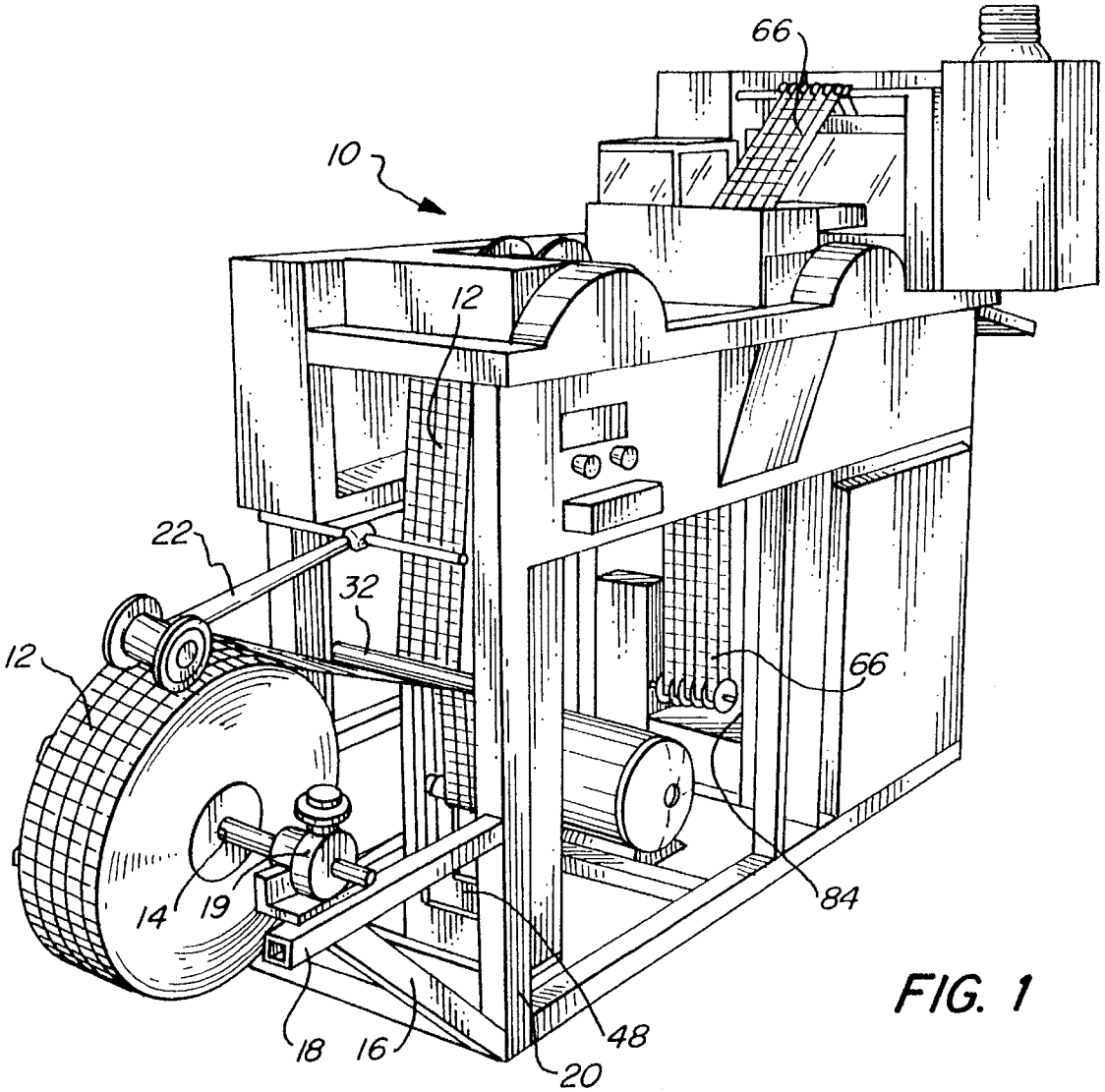
FIG. 1 is an isometric view of a machine for slitting, winding, sealing and unloading individual rolls of stamps from a web, constructed in accordance with the present invention.

Referring to the drawings in detail, where like numbers identify like elements, a machine 10 is shown for slitting, winding, sealing and unloading coreless rolls of stamps from a web of material 12.

Figure 2:
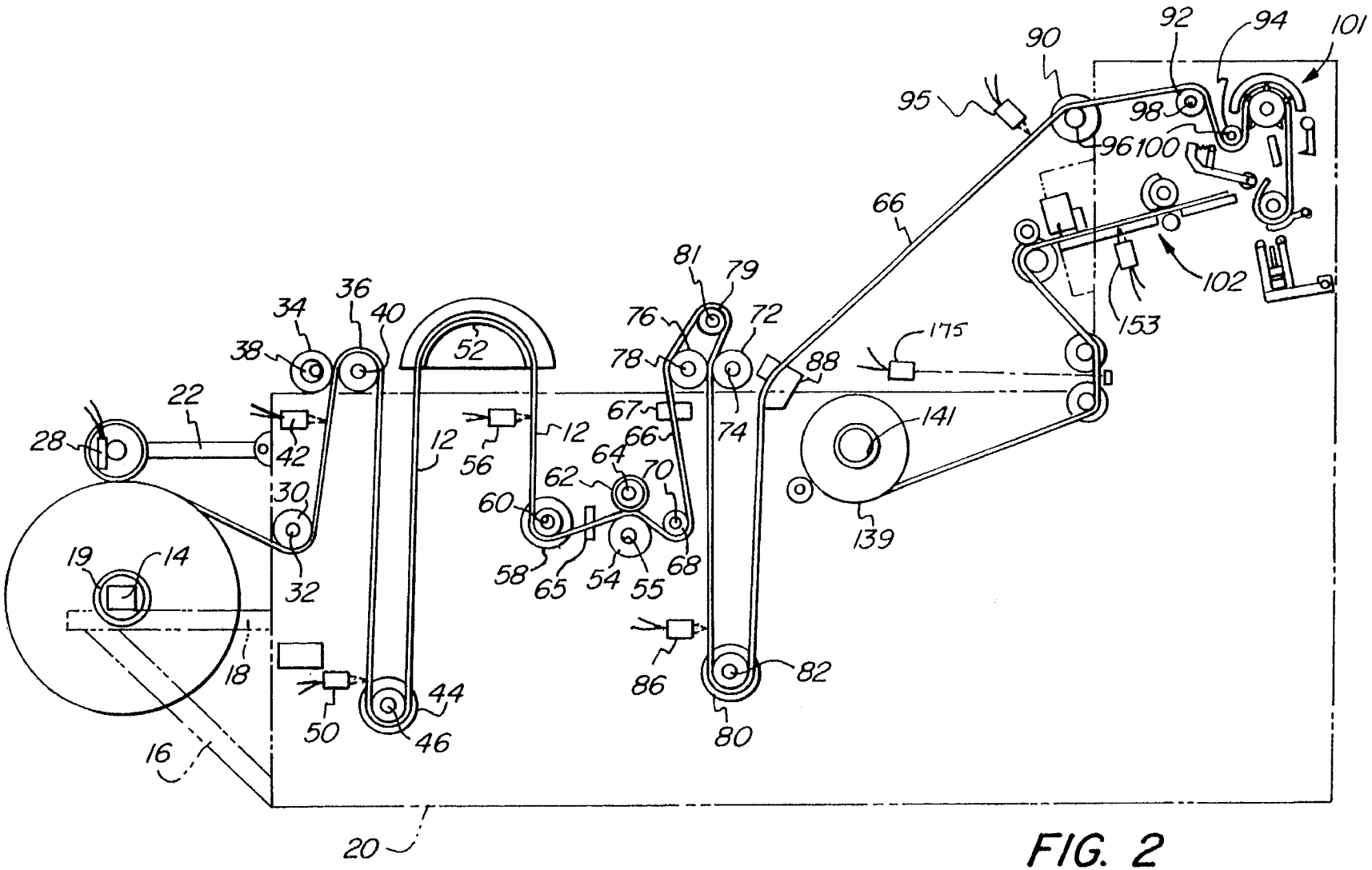
FIG. 2 is a side view of the machine, shown in FIG. 1, with the frame removed to show the path of the stamps and the winding and packaging mechanisms.

The web of stamps 12 enters the machine 10, shown in FIG. 1, and generally follows the path indicated in FIG. 2. The web of stamps 12 is most preferably an unslit, printed and perforated five-stamp wide stock, although any suitable web of any suitable width could be used. Web 12 is shown as a tightly wound roll at one end of machine 10 which is freely rotatable about center axis 14. Web 12 is supported by cantilevered strut 16 and brace 18 securely attached to machine frame 20. Adjustable drag brake 19, such as a manually operated pneumatic drag brake, is attached to the roll to prevent uncontrolled unwinding of the stock. Bar 22 is pivotally attached to frame 20 and positions counter 28 on web 12.

Counter 28 indicates to an operator the footage of web 12 that has been processed. Any suitable counter can be used such as a rotary encoder and an electric counter. The rotary encoder can be driven by a wheel (not shown) which can be located on the roll. Most preferably, the circumference of the wheel is designed such that one revolution equals a known length. As such, the output from the encoder, which measures the revolutions, can be used to determine the length of material processed.

As shown in FIG. 2, web 12 is fed into machine 10 and around freewheel 30, which rotates about a central axis defined by central shaft 32. Motor-driven nip roller 36 cooperates with roller 34, located in a plane above freewheel 30, to feed web of material 12 about roller 36. Nip roller 34 is movable towards and away from roller 36, such that nip roller 34 can contact roller 36 when it is desirable to advance more web 12 into the loop. Central shaft 40 of nip roller 36 is substantially parallel to central shaft 38 of roller 34. Sensor 42, adjacent the path of the web 12 between freewheel 30 and roller 36, monitors the stamps to sense a broken web 12 (or an expired web) and will automatically stop machine 10 to prevent running all the web through machine 10 and causing a rewebbing problem. Any suitable sensor can be used, such as a reflective photoeye, which is designed such that a missing piece of web 12 will activate the eye but perforations in web 12 will not give a false signal.

Web 12 is fed about loop roller 44, which is a loose floating, weighted loop roller. Roller 44 rotates about central axis 46. Loop roller 44 also moves within chute guide 48 (shown in FIG. 1). Roller 44 and web 12 move vertically within chute guide 48 to ensure that the appropriate tightness and an appropriate reservoir of web 12 is maintained in the loop. Sensor 50, located along the path of roller 44, monitors the location of loop roller 44. When loop roller 44 passes above sensor 50, indicating that the reservoir is being depleted, sensor 50 electrically communicates with nip roller 34 to move nip roller 34 towards roller 36. When nip roller 34 frictionally contacts roller 36, more web 12 enters the loop and loop roller 44 moves downwardly to maintain the appropriate amount of web 12 in the loop. After the appropriate amount of web 12 is fed into the loop, sensor 50 communicates with nip roller 34, then nip roller 34 moves away from roller 36. When loop roller 44 moves upward again due to removal of web 12 from the loop, the cycle is repeated.

Loop roller 44 guides web 12 in a substantially vertical path towards the top of machine frame 20 and about curved surface 52, having side guide plates (not shown) to precisely guide web 12 laterally into rotary slitters 54, 62. Sensor 56, located in the plane below curved surface 52, scans web 12 to warn the operator, such as by an audible or visual alarm, that a faulty or spliced web piece is about to pass by slitter blades 54, 62. Male slitter blades 62, rotating about central axis 64, are located in substantially the same plane as female slitter blades 54, having central axis 55, whereby central axis 64 is substantially parallel to central axis 55. Guide roller 58, which rotates about central axis 60, is located in the web path prior to slitter 54 to further enhance the lateral guidance of web 12. Guide plates 65 provide additional lateral guidance of web 12 into slitters 54, 62.

After passing through slitters 54, 62, web 12 continues along the path as five individual slit webs 66 (also shown in FIG. 1), although it should be understood that the number of slit webs could vary, as desired. The path of only one web 66 is described herein for convenience. The path of the other webs 66 is identical. Web 66 is fed about guide roller 68, having central shaft 70. Central shaft 70 lies substantially in the same plane as central shaft 60 of roller 58. Individual webs 66 are slightly separated from each other by guide plates 67, after passing around guide roller 68.

Slit web 66 is then fed by a second nip roll system into a second free loop. In particular, the nip roll system includes driven nip roller 76, which rotates about central axis 78. Freewheel 72 rotates about central axis 74 and moves toward and away from freewheel 78. Roller 79, having central axis 81, lies above the plane containing central axes 74, 78. When roller 76 and roller 72 contact, more web 66 is fed into the second free loop, in substantially the same manner as was described for the first free loop. The appropriate amount of web 66 is positioned into a loop by loop roller 80, which rotates about axis 82, and which moves vertically within a chute guide 84 (shown in FIG. 1). Loop roller 80 has plates (not shown) which separate the plurality of webs 66 slightly farther apart. Sensor 86 monitors the position of loop roller 80, in substantially the same manner as sensor 50, previously described, to maintain the appropriate amount of web 66 in the second loop.

On exiting machine 10, web 66 passes through additional guides 88 and rollers 90, 92, 94, having respective central shafts 96, 98, 100. Guides 88 and rollers 90, 92, 94 further guide and separate the plurality of webs 66.

Sensor 95, similar to sensor 56, between roller 90 and guides 88, senses a spliced or otherwise unacceptable web 66. A counter and an additional sensor (not shown) cooperate with sensor 95 to count the perforations that pass by. The counter is operably connected to a preset counter, which is set for the fixed machine distance between the counter and knife 158, shown in FIGS. 3–11. As such, the amount of unacceptable web 66 can be determined, separated, coiled, and appropriately discarded, as discussed herein.

Web 66 then passes into winding 101 and packaging 102 mechanisms of machine 10. The winding and packaging steps are better shown in FIGS. 3–11.

In winding 101 and sealing 102 portion, web 66 is fed onto a sprocket, such as a five-pinned sprocket, 104, which rotates about central shaft 106. Through operation of a pre-programmed sequence controlled by a computer, web 66 is fed down simultaneously onto variable-diameter core 108, having central axis 110. Core 108 can comprise an expandable diameter jacket, such as bladder 112 (better shown in FIG. 12). This permits core 108 to be expanded when in position to have slitted web of material 66 wound thereabout. However, when it is desired to remove the wound web 66, core 108 is contracted to facilitate removal. Core 108 is also described in Applicant's previously filed application, accorded U.S. Ser. No. 07/895,268, filed on Jun. 8, 1993, and entitled "Apparatus and Method for Preparing Individual Wound Rolls from a Slitted Web of Material". That application is hereby incorporated by reference.

Figure 3:
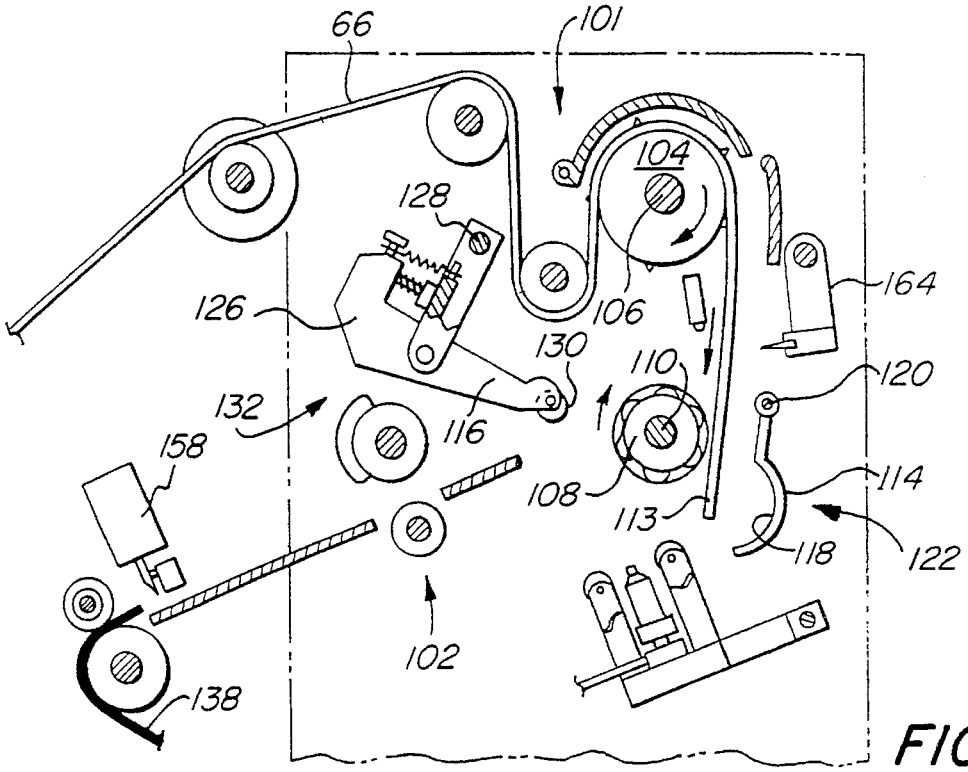
FIGS. 3–11 are schematic views, showing a sequence of steps for tucking and winding stamps about a core, and applying a sealing material to retain the stamps in a tightly wound position, one step of which is shown in FIG. 2.
Figure 4:
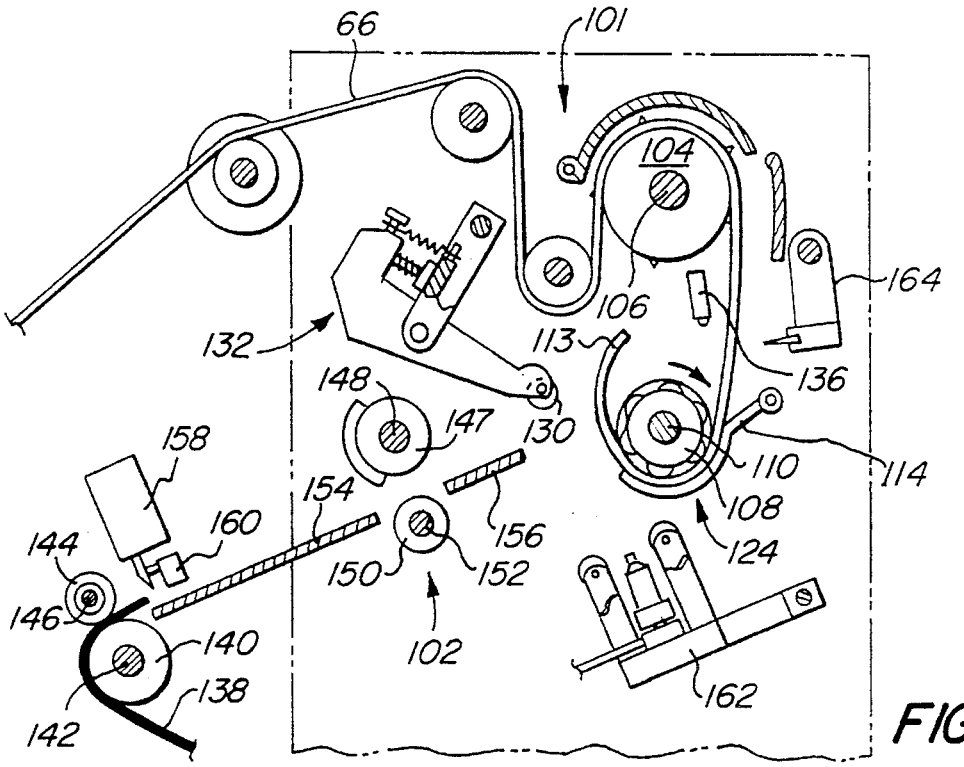
Figure 5:
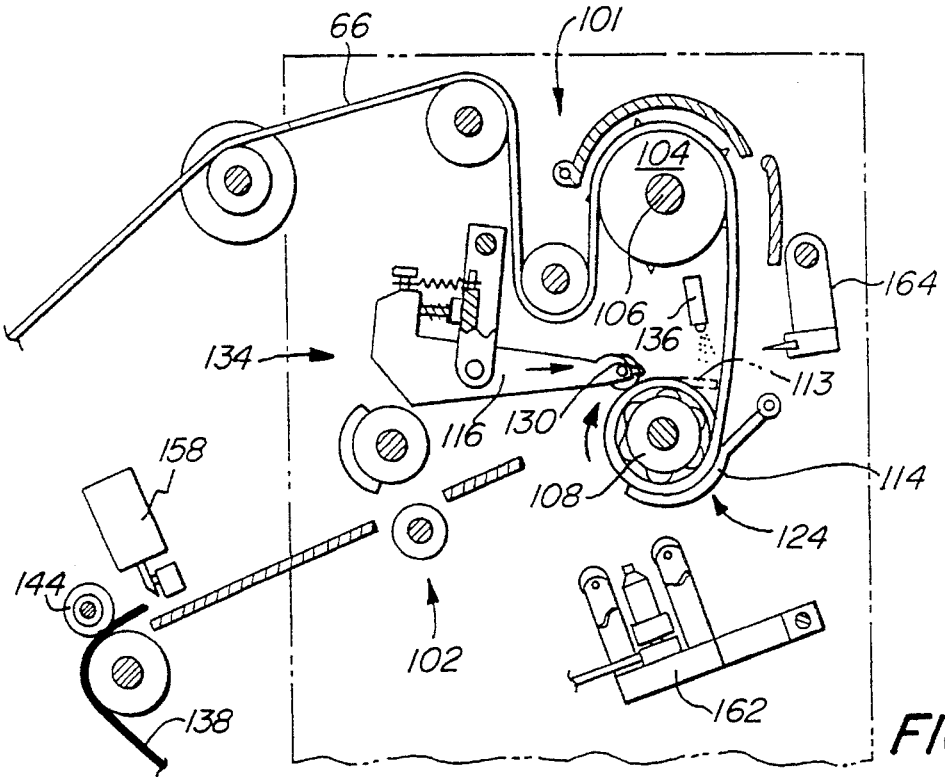

Leading edge 113 of slit web 66 is then tucked about core 108 by tucking apparatus, which generally comprises a first tucker 114 and second tucker 116. First tucker 114 includes a pivotable member having a substantially concave surface 118 which contacts core 108 at a plurality of points, wherein the radius of concavity of tucker 114 is approximately equal to the radius of core 108. First tucker 114 pivots about hinge 120 to move between a retracted 122 and tucking 124 position. Retracted position 122 is shown in FIGS. 3, 6–11, while tucking position 124 is shown in FIGS. 4, 5. First tucker 114 is actuated by any suitable means, such as pneumatically, electrically, or mechanically, and is positioned for tucking when needed, but is otherwise retracted to reduce unnecessary drag on the winding of slitted web 66.

Figure 9:
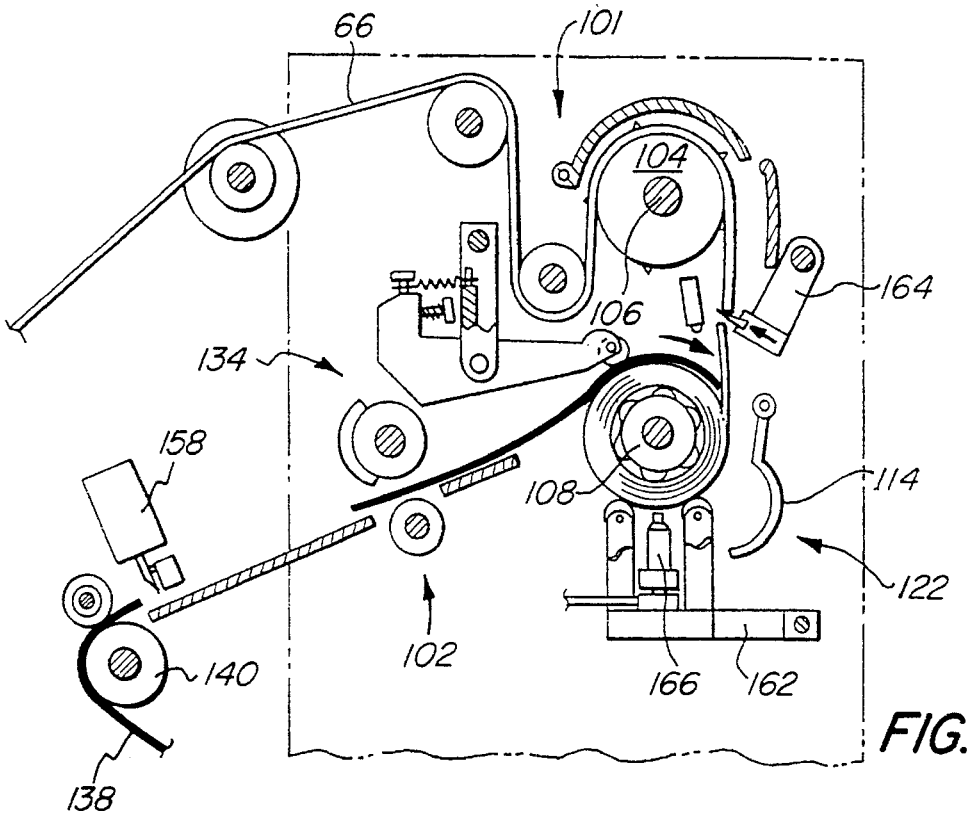
Figure 10:
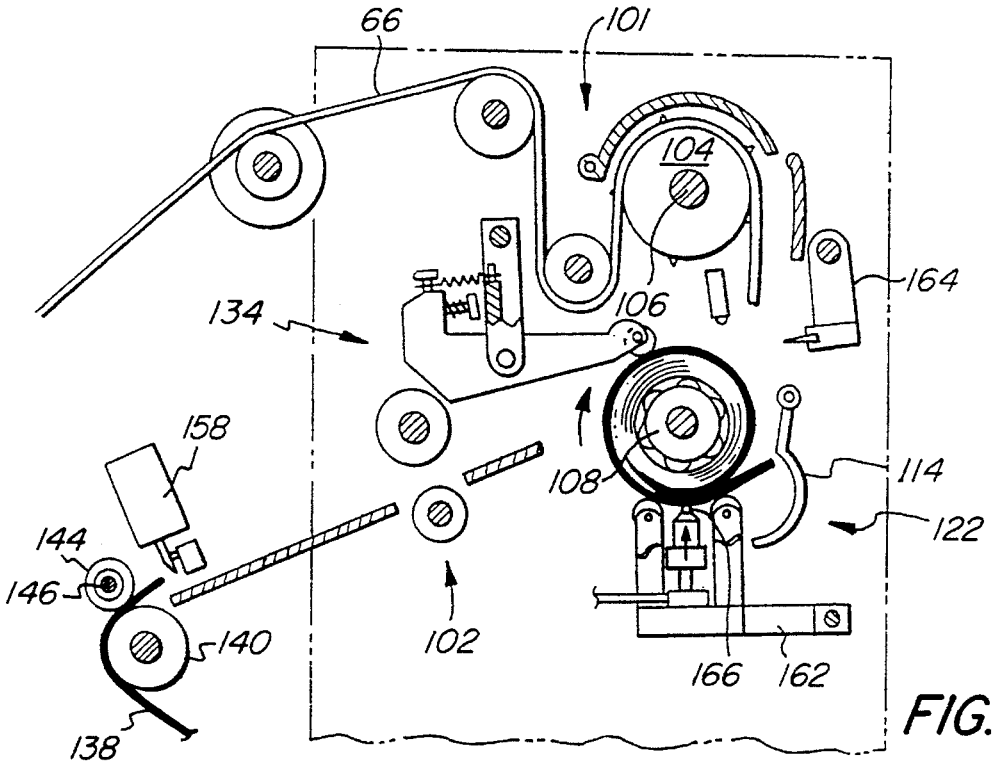
Figure 11:
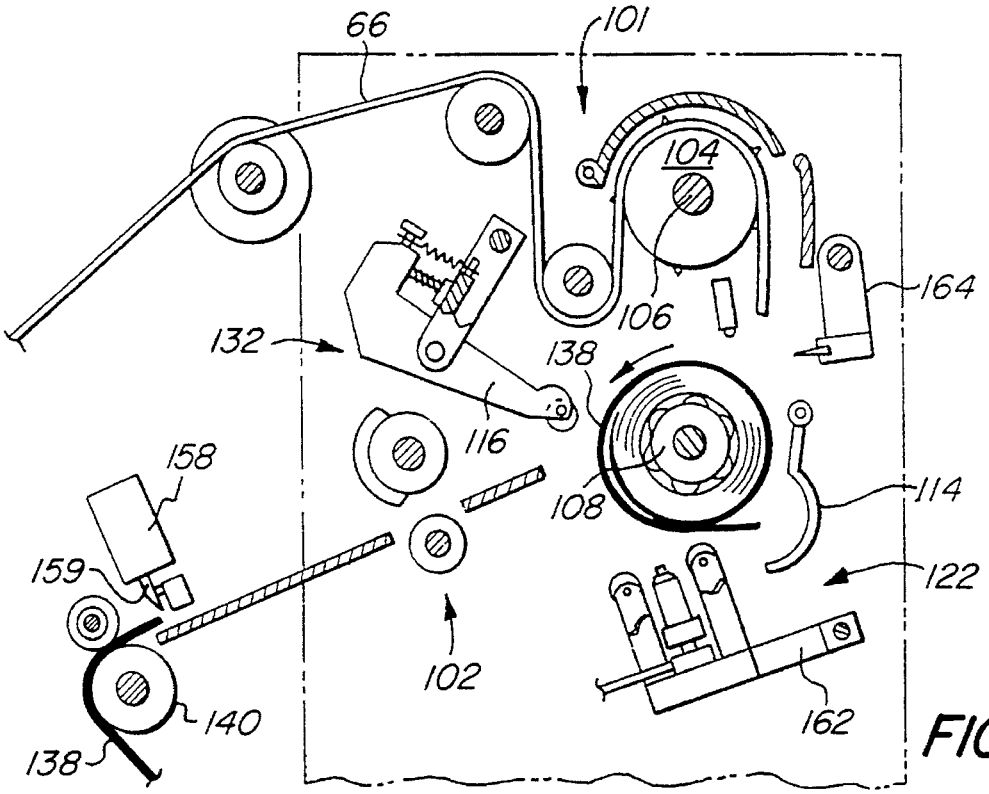

Second tucker 116 generally includes a pivotable, spring-loaded arm member 126, which pivots about a hinge 128, and which has an attached rotatable freewheel 130, attached to an end of arm 126, for facilitating tucking and winding. Second tucker 116 pivots about hinge 128 between a retracted 132 and tucking 134 position. Retracted position 132 is shown in FIGS. 3, 4, 11, and tucking position 134 is shown in FIGS. 5–10.

A source of compressed air 136 provides a stream of air which assists in tucking leading edge 113 of web 66 about core 108.

Packaging, or sealing mechanism, 102 includes a seal tape, such as a heat seal tape, 138, which is a heat sealable coated paper tape with a single adhesive side. It is preferred that the sealing tape 138 be made from any suitable material such as plastic, that can be sealed onto itself such as by heat sealing. It is also preferred that the tape not include an adhesive that will stick to the rolled material or otherwise be positioned so as to adhere to the rolled material.

Tape 138 is fed from a supply roll 139 having central axis 141, shown in FIG. 2. Tape 138 is driven by roller 140, which rotates about central axis 142, and nip roller 144, which rotates about central axis 146, better shown in FIGS. 4, 6–8. Drive roller 140 and nip roller 144 are controlled by a single revolution feed clutch. Roller 147, driven by a second single revolution clutch, rotates about central axis 148, and cooperates with roller 150, having central axis 152 to advance cut tape 138 at the proper time in the machine cycle. Tray guides 154, 156 further facilitate guiding tape 138.

Sensor 153 (shown in FIG. 2) is designed to stop machine 10 if tape 138 jams or otherwise malfunctions. Other sensors (not shown) can be used, as desired, to sense any missing tape and to automatically shut down machine 10 if no tape is present or to otherwise monitor the performance of tape 138.

Figure 6:
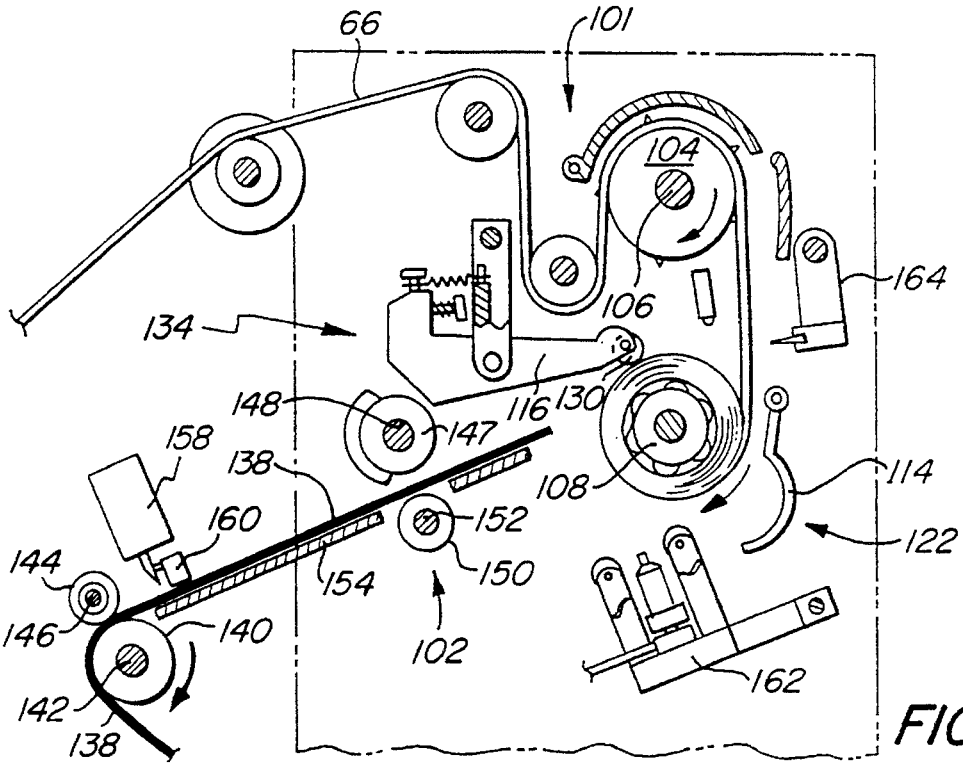
Figure 7:
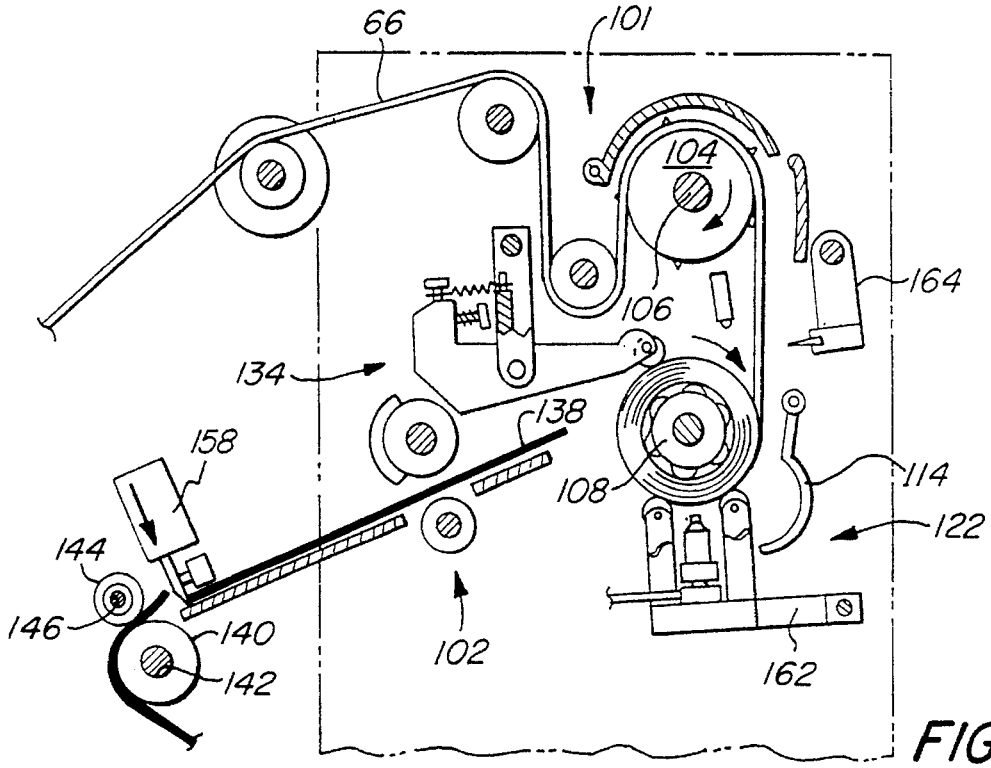

As shown in FIGS. 6–7, tape 138 is cut at a predetermined length by knife 158, having blade 159. A sponge-rubber piece 160 is located adjacent blade 159 and prevents tape 138 from becoming misaligned or sticking to blade 159 after cutting tape 138. It should be understood, however, that any suitable substitute could be used for the sponge rubber piece, so long as it effectively prevented tape 138 from moving and/or sticking to knife 158 or blade 159. Heat sealing unit 162, having heating element 166, applies heat to tape 138 to seal tape 138 onto itself, as best shown in FIGS. 9–10.

In operation, leading edge 113 of web 66 is fed simultaneously, through operation of a preprogrammed computer or any suitable programming system, towards expanded core 108, shown in FIG. 3.

Leading edge 113 is tucked about core 108 by first tucker 114 which has moved to tucking position 124, shown in FIG. 4. Core 108 is driven in a torque controlled coordinated move with feed wheel 104 and in a clockwise direction such that leading edge 113 continues to be wound about core 108. Second tucker 116 then moves from retracted position 132, shown in FIG. 4, to tucking position 134, shown in FIG. 5, to facilitate tucking of leading edge 113. A single blast of air from compressed air source, or air jet, 136 forces leading edge 113 towards core 108 and behind infeeding web 66.

Then, as shown in FIG. 6, tucker 114 moves to retracted position 122 to reduce unnecessary drag on the winding of web 66. Tucker 116 continues to guide winding of web 66 about core 108 through freewheel 130. As the winding continues, sealing mechanism 102 advances sealing tape 138 up guide tray 154.

At a predetermined time, roller 140 feeds tape 138 towards core 108. When tape 138 reaches a predetermined length, knife 158 cuts tape 138, and sponge-rubber piece 160 swipes knife 158. See FIGS. 6, 7. At another predetermined time, roller 147 kicks cut tape 138 into nip formed between roller 130 & wound web 66 on core 108 as shown in FIG. 9. Substantially simultaneously, heat sealing unit 162 moves into position adjacent core 108 to prepare to seal tape 138 about wound web 66.

Figure 8:
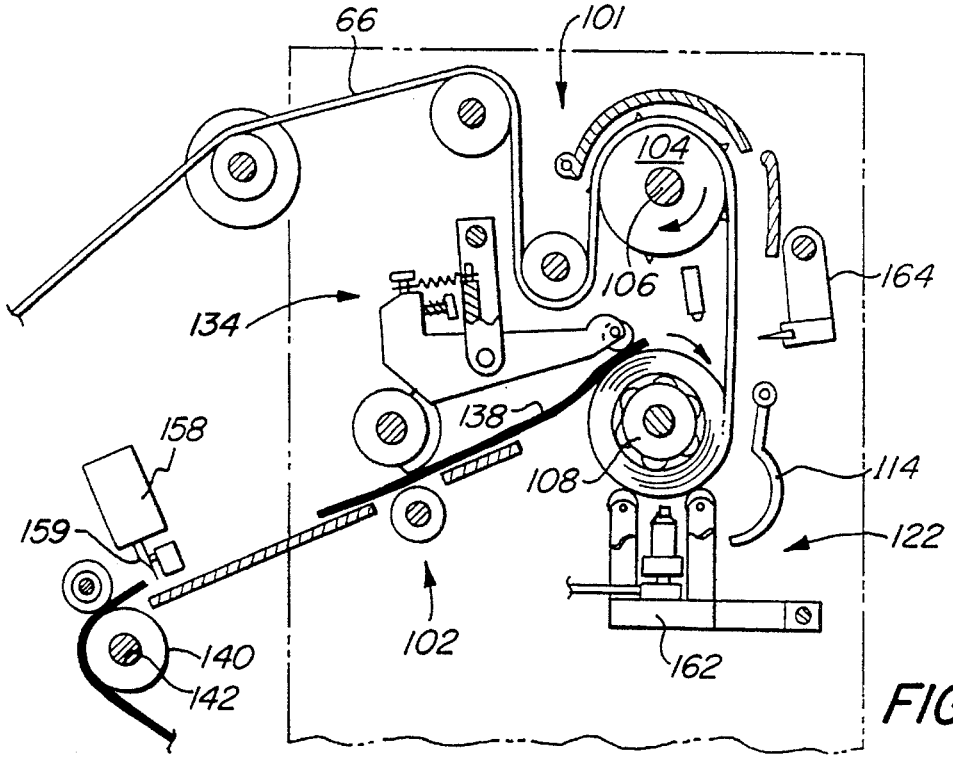

As shown in FIG. 8, tucker 116 remains in tucking position 134 and facilitates placement of tape 138 about wound rolls of web 66. Sealing tape 138 is wrapped about core 108, as shown in FIG. 9, while knife 158 cuts web 66 at a predetermined length and position, such as at the perforations between the stamps.

FIG. 10 shows tape 138 completely wrapped around wound web 66. Most preferably, tape 138 travels more than one revolution about web 66 to ensure that tape 138 is not sealed to web 66. Heat element 166, inside sealing unit 162, advances toward sealing tape 138 and heat seals tape 138 onto itself, thus retaining cut and wound web 66 in a tightly-held, coiled position. Preferably, tail 175*a*, 175*b*, for example (shown in FIG. 13) projects from the sealed web 66 to facilitate opening by a user.

As shown in FIG. 11, tucker 116 returns to a retracted position 132. Core 108 is contracted to facilitate removal of wound web 66. Heating element 162 moves away from core 108 and core 108 reverses its rotational direction as indicated.

Figure 12:
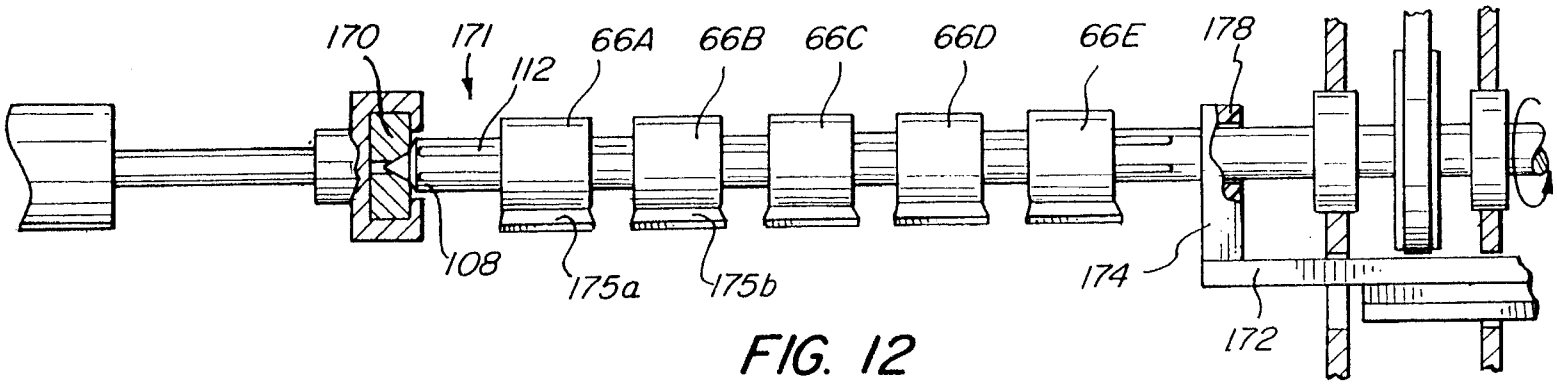
FIGS. 12–13 are end views, FIG. 12 being in partial cross section, showing a core supporting sealed rolls of stamps which are removed from the core by a moveable extractor.

Individual wound and packaged rolls 66A, 66B, 66C, 66D, 66E, for example, are formed as shown in FIG. 12. Wound and sealed rolls 66A, 66B, 66C, 66D, 66E are removed from core 108. Core support member 170, which is movable between an attached 171 and dislocated 173 position relative to core 108, houses a bearing to support end of core 108. Member 170 is shown in attached position 171 in FIG. 12 and a dislocated 173 position in FIG. 13. Movable extractor 172, having a substantially perpendicular arm 174, is positioned parallel to core 108 and positioned on one end of core 108 opposite support member 170. Arm 174 has hole 178 adapted to snugly receive core 108, preferably when core 108 is in its reduced diameter condition.

Figure 13:
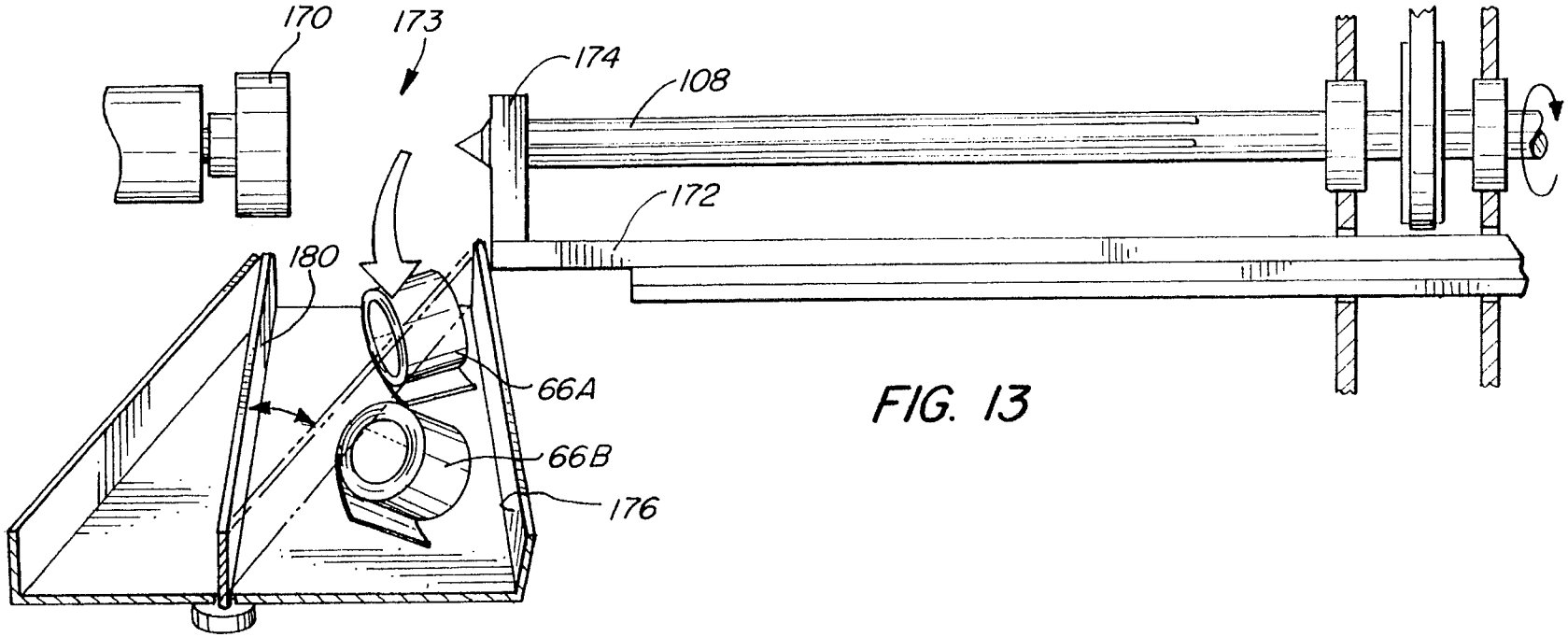

After support member 170 is moved to dislocated position 173, shown in FIG. 13, extractor 172 moves arm 174 across core 108, forcing wound rolls 66A, 66B, 66C, 66D, 66E, for example, into bin or chute 176. See FIG. 13. Bin 176 is bidirectional. That is, diverter gate 180 is movable between a first and second position. For example, irregular rolls would be discarded into a first partition, while satisfactory rolls would be dumped into a second partition.

During the winding and sealing processes, a spliced or otherwise unacceptable piece of web 66 may be included in web 12. Sensors 56, 95 (shown in FIG. 2) detect unacceptable web 12, 66, respectively, and activate alarms (not shown) to notify an operator visually or audibly, as desired. When an unacceptable web 66 has been detected, the counter opposite sensor 95 counts the length of web 66 between sensor 95 and knife 158. The acceptable portion of web 66 preceding the spliced web is cut, wound, and rolled, as described, and directed into a first partition of bin 176. The splice containing web 66 is then cut, wound, and rolled. Diverter gate 180 then moves to repartition bin 176 such that unacceptable wound rolls fall into a second partition of bin 176. After machine 10 begins the next winding cycle, diverter gate 180 is automatically repositioned to direct acceptable web 66 into the first partition and the alarms are deactivated.

It should be understood by those skilled in the art that any suitable retaining material could be used in place of sealing tape 138. Alternative retaining members include: gummed tape, latex coated tapes, and plastic or metal clips.

It should further be understood by those skilled in the art that obvious modifications can be made without departing from the spirit of the invention. Accordingly, reference should be made primarily to the accompanying claims, rather than the foregoing specification, to determine the scope of the invention.

We claim:

1. An apparatus for preparing coreless wound rolls from a web of material, comprising:

means for slitting a single web into a plurality of individual slitted webs, each of the individual slitted webs having a leading edge;

means for substantially concurrently feeding the leading edge of each of the individual slitted webs of material into contact with a core having a central axis;

means for tucking the leading edge of each of the individual slitted webs of material about the core, the tucking means comprising:

at least one first tucker having a curved surface which contacts the leading edge of at least one of the individual slitted webs on the core at a plurality of points, the first tucker having a contacting and retracted position, wherein the first tucker tucks at least the leading edge of at least one of the individual slitted webs about the core for approximately one rotation of the web about the core when in the contacting position and then moves to the retracted position;

at least one second tucker comprising at least one freewheel which contacts at least the leading edge of at least one of the individual slitted webs of material about the core and which moves radially from the central axis of the core as the web is wound around the core;

at least one third tucker which provides a stream of air for tucking the leading edge of at least one of the individual slitted webs against the core;

means for winding each of the individual slitted webs of material about the core; and means for retaining each of the individual slitted wound webs of material in a tightly wound condition while each of the individual wound webs are on the core, the retaining means comprising a base and at least one heating element attached to the base for heat welding retaining material which has been wound around each of the individual wound webs of material such that the retaining material secures each of the individual wound webs of material in the wound position and further comprising at least two support members, each support member having an upper and a lower end, the lower end of each of the support members being attached to the base, each support member further comprising a freewheel rotatably mounted at the upper end, one support member being positioned on each side of the heating element and positioned such that the freewheel contacts the retaining material and facilitates retaining the individual slitted, wound webs about the core.

2. The apparatus for preparing coreless wound rolls from a web of material of claim 1, the retaining means further comprising means for advancing the retaining material towards at least one of the individual slitted wound webs of material about the core, the advancing means comprising at least one driver roller which rotates about a central axis, and at least one nip roller which rotates about a central axis, wherein the central axis of the driver roller and the central axis of the nip roller lie in substantially the same plane, wherein the retaining material passes between the driver roller and the nip roller and towards the core.

3. The apparatus for preparing coreless wound rolls from a web of material of claim 2, the retaining means further comprising at least one guide tray having a smooth surface for supporting the retaining material, the guide tray lying substantially in a plane extending between the central axis of the core and the central axis of the driver roller.

4. The apparatus for preparing coreless wound rolls from a web of material of claim 1, further including a movable extractor having an extendable member and an attached stationary member, the stationary member having means for receiving the core, the extendable member located in substantially the same plane as the central axis of the core, and the stationary member being substantially perpendicular to the extendable member, wherein the core passes through the receiving means and is substantially parallel to the extendable member.

5. The apparatus for preparing coreless wound rolls from a web of material of claim 1, the core having a radius, the first tucker having a substantially concave surface with a radius of concavity approximately equal to the radius of the core.

6. The apparatus for preparing coreless wound rolls from a web of material of claim 1, wherein the web of material includes a perforated web of stamps slitted into individual strips.

7. The apparatus for preparing coreless wound rolls from a web of material of claim 1, wherein the feeding means includes a star-shaped feeder roller which rotates about a central axis, wherein the central axis of the core lies in substantially the same plane as the central axis of the feeder roller.

8. An apparatus for preparing coreless wound rolls from a web of material, comprising:

means for slitting the web into a plurality of individual slitted webs, each of the individual slitted webs having a leading edge;

means for substantially concurrently feeding each of the individual slitted webs of material into contact with a core having a central axis:

means for tucking each of the leading edges of each of the individual slitted webs of material about the core, the core having a predetermined radius, the tucking means comprising:

a plurality of first tuckers, each first tucker having a surface which contacts the leading edge of each of the individual slitted webs at a plurality of points, each of the first tuckers having a substantially concave surface with a radius of concavity approximately equal to the radius of the core, each of the first tuckers having a contacting and retracted position, wherein each of the first tuckers tuck the leading edge of each of the individual slitted webs about the core for approximately one rotation of each of the individual slitted webs about the core and then moves to the retracted position;

a plurality of second tuckers, each of the second tuckers comprising at least one freewheel which contacts the leading edge of each of the individual slitted webs of material about the core, wherein each freewheel moves radially from the central axis of the core as each of the individual slitted webs are wound around the core; and a plurality of third tuckers, each of the third tuckers providing a stream of air for tucking the leading edges of the individual slitted webs against the core;

means for winding each of the individual slitted webs of material about the core; and means for retaining each of the individual slitted wound webs of material in a tightly wound condition while each of the individual wound webs are on the core, the retaining means comprising at least one heating element for heat welding retaining material which has been wound around each of the individual wound webs of material such that the retaining material secures each of the individual wound webs of material in the wound position.

9. The apparatus for preparing coreless wound rolls from a web of material of claim 8, the retaining means further comprising means for advancing a retaining material towards at least one of the individual slitted wound webs of material about the core, the advancing means comprising at least one driver roller which rotates about a central axis, and at least one nip roller which rotates about a central axis, wherein the central axis of the driver roller and the central axis of the nip roller lie in substantially the same plane, wherein the retaining material passes between the driver roller and the nip roller and towards the core.

10. The apparatus for preparing coreless wound rolls from a web of material of claim 9, the retaining means further comprising at least one guide tray having a smooth surface for supporting the retaining material, the guide tray lying substantially in a plane extending between the central axis of the core and the central axis of the driver roller.

11. The apparatus for preparing coreless wound rolls from a web of material of claim 8, further comprising at least one movable extractor having an extendable member and an attached stationary member, the stationary member having means for receiving the core, the extendable member located in substantially the same plane as the central axis of the core, and the stationary member being substantially perpendicular to the extendable member, wherein the core passes through the receiving means and is substantially parallel to the extendable member.

12. The apparatus for preparing coreless wound rolls from a web of material of claim 8, wherein the web of material comprises a perforated web of stamps slitted into individual strips.

* * * * *